US005448787A

United States Patent [19]

Allen

[11] Patent Number: 5,448,787

[45] Date of Patent: Sep. 12, 1995

[54] SPA HAVING HEIGHT-ADJUSTABLE SEAT

[75] Inventor: Don T. Allen, Norman, Okla.

[73] Assignee: Mapletree Investments, Norman, Okla.

[21] Appl. No.: 111,913

[22] Filed: Aug. 26, 1993

Related U.S. Application Data

[63] Continuation-in-part of Ser. No. 958,709, Oct. 9, 1992, abandoned.

[51] Int. Cl.[6] ..... A47K 3/12

[52] U.S. Cl. ..... 4/559; 4/541.1; 4/565.1; 4/579

[58] Field of Search ..... 4/495, 499, 501, 541.1, 4/541.3, 541.4, 541.5, 560.1, 564.1, 565.1, 566.1, 573.1, 578.1, 579, 581, 582, 583, 559

[56] References Cited

U.S. PATENT DOCUMENTS

| | | | |
|---|---|---|---|
| 1,683,430 | 9/1928 | Wright | 4/566.1 X |
| 3,178,730 | 4/1965 | Bogar | 4/559 X |
| 4,780,916 | 11/1988 | Sutton | 4/541.5 |
| 4,986,781 | 1/1991 | Smith | 4/541.3 X |

FOREIGN PATENT DOCUMENTS

| | | | |
|---|---|---|---|
| 2131291 | 6/1984 | United Kingdom | 4/565.1 |

*Primary Examiner*—Robert M. Fetsuga
*Attorney, Agent, or Firm*—Wigman, Cohen, Leitner & Myers

[57] ABSTRACT

An adjustable seat for a spa. The spa has a seating or lounge area formed thereon of such shape and dimensions as to permit a person of typical physical dimensions to be seated in a lounging position. A nozzle is provided in the seating region of the lounge. A mixture of air and water flow through the nozzle and communicate with a plenum formed in the underside of a seat having one or more holes therein and fitted over the nozzle. The flow of air in combination with water serves to elevate the seat. An air valve serves to regulate the quantity of air drawn in by the water flowing through the nozzle, which, in turn, regulates the elevation of the seat. The lounge spa can be made as an original equipment unit. Alternatively, a seating system may be provided which is adapted to be retrofitted to an existing spa.

12 Claims, 3 Drawing Sheets

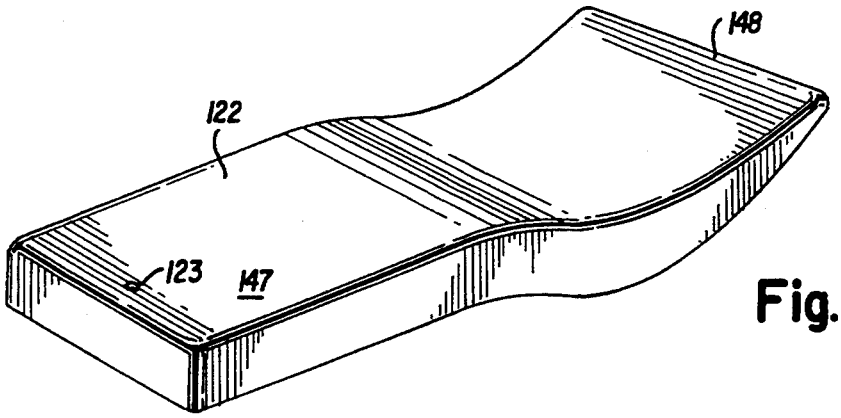
Fig. 9
Fig. 8
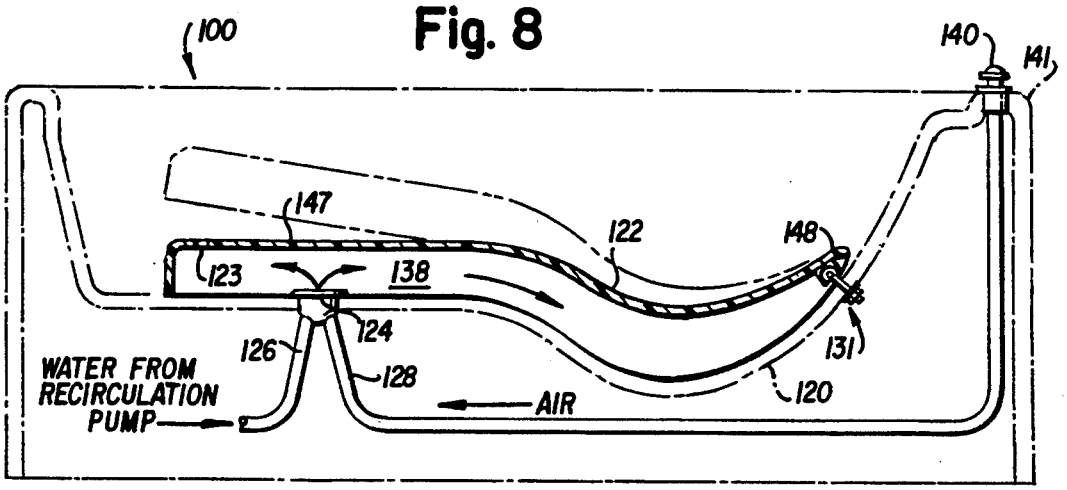
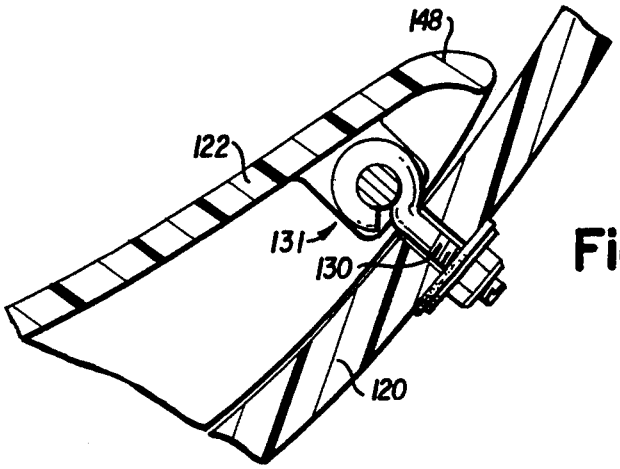
Fig. 10

SPA HAVING HEIGHT-ADJUSTABLE SEAT

CROSS-REFERENCE TO RELATED APPLICATION

This is a continuation-in-part of U.S. patent application Ser. No.: 07/958,709 filed Oct. 9, 1992, abandoned.

TECHNICAL FIELD

This invention relates to an improved spa and seat for a spa. Specifically, the invention relates to an adjustable seat which can be elevated by a combined air and water pressure applied to a porous plenum beneath the seat. Alternatively, air pressure only or water pressure only can be used to elevate the seat.

BACKGROUND OF THE INVENTION

Vessels filled with water in varying temperatures have been used by humankind for relaxation, cleansing and therapy for centuries. The most common vessel of this type is the bath tub used by millions worldwide everyday. Most use water of varying temperatures and the user submerges himself or herself in the water. Since the onset of the twentieth century, electric motors and pumps have been used to activate and circulate the water through a variety of nozzles and orifices. The massaging action of the water is enjoyable and beneficial to most users. The modern name for vessels of this type is hot tubs, jetted tubs or spas. These three types of vessels will hereafter be referred to as spas.

Spas have been made in a wide variety of shapes, forms, and depths. The most popular shape in the decade of the 1970's was the octagon. This bench seat style with eight sides provided basically only one seating position. In the decade of the 1980's a new model was made by many manufacturers and called a lounger spa. This spa has a lounge seat on the side of the spa and/or a variety of bench or bucket seats in the rest of the spa. The shape of this spa is usually square or rectangular. These lounge seats have always been stationary and have been made in a wide variety of forms and shapes. The most significant difficulty with the lounge spa is that individuals who were short or overweight floated out of the lounge.

The disadvantages of the prior art spas are addressed by the present invention.

SUMMARY OF THE INVENTION

The present invention is directed to a seating or lounge area formed in the spa of such shape and dimensions as to permit a person of typical physical dimensions to be seated in a lounging position. In a first embodiment, a nozzle is provided in the posterior or buttocks region of the lounge. Fluid pressure is provided in the form of a mixture of air and water which flow through the nozzle and communicate with a plenum formed in the underside of a porous seat fitted over the nozzle. The fluid flow in the form of air in combination with water serves by buoyancy and pressure to elevate the seat. An air valve serves to regulate the quantity of air drawn in by the water flowing through the nozzle, which, in turn, regulates the elevation of the seat. In a second embodiment, the nozzle for providing fluid flow is located in the leg region rather than the buttocks region. Rather than the seat being porous, a single hole is provided for the air to escape from the plenum formed in the underside of the seat of the second embodiment. Instead of using a combination of air and water to elevate the seat by means of buoyancy and pressure, it is contemplated that water pressure only or air pressure only can be used. The lounge spa can be made as an original equipment unit. Alternatively, a height adjustable seating system may be provided which is adapted to be retrofitted to an existing spa.

With the foregoing and other advantages and features of the invention that will become hereinafter apparent, the nature of the invention will be more clearly understood by reference to the following detailed description of the invention, the appended claims and to the views illustrated in the attached drawings.

BRIEF DESCRIPTION OF THE DRAWINGS

FIG. 8 is a sectional view of a fourth embodiment of a spa having a height-adjustable seat retrofitted therein;

FIG. 9 is a perspective view of the fourth embodiment of a height-adjustable spa seat; and FIG. 10 is a detail of a pivotal connection of the fourth seat embodiment to a spa.

DETAILED DESCRIPTION OF THE INVENTION

Figure 1:
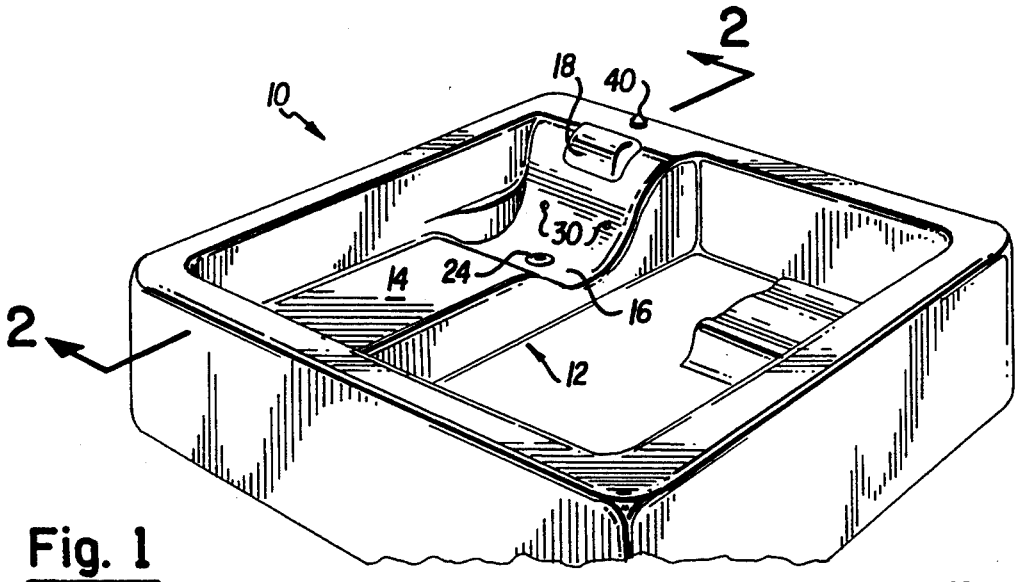
FIG. 1 is a perspective view of a first embodiment of a spa showing a lounge area formed therein, with an adjustable seat according to the invention removed.
Figure 2:
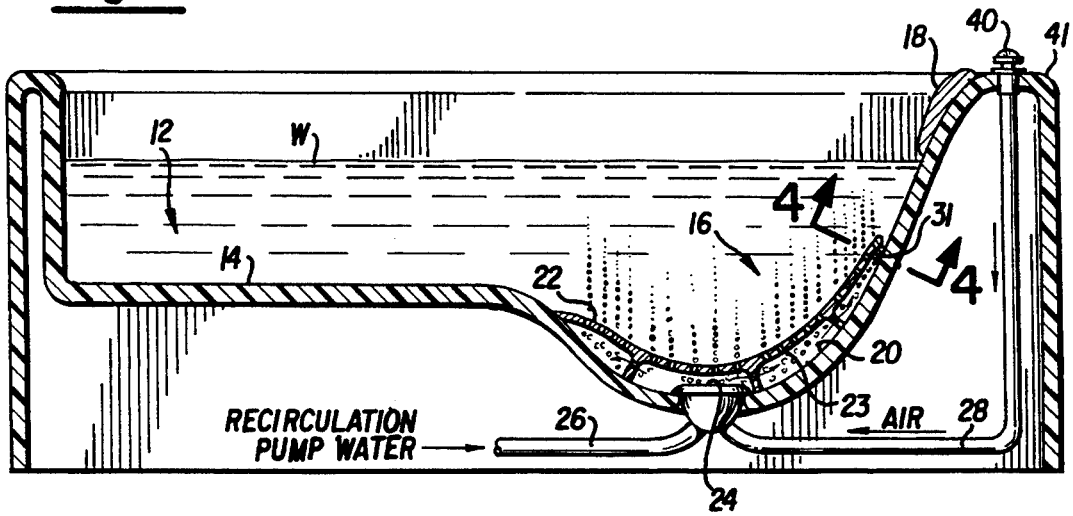
FIG. 2 is a sectional view taken along line 2—2 of FIG. 1, with the adjustable seat according to a first embodiment of the invention installed.

Referring now in detail to the drawings, there is illustrated in FIGS. 1 and 2 a spa designated generally with the reference numeral 10 with a lounge 12 formed integrally therein, with FIG. 1 showing a perspective view, with an adjustable seat removed, and FIG. 2 showing a sectional view along line 2—2 of FIG. 1, with the spa 10 filled with water W. The lounge 12 is formed so as to permit a person to be seated in a semi-reclined or lounging position. The lounge 12 has a leg area 14, a buttocks or posterior area 16, and a head or neck area 18.

The posterior area 16 has a base 20 formed integrally with the spa 10. As shown in FIG. 2, a seat 22 is mounted in height-adjustable fashion over the base 20. A nozzle 24, attached to a water line 26 and air line 28, is provided in the base 20 and located beneath the seat 22. Attachment bolts 30 are provided to hingedly support the seat 22 by a connection 31. The seat 22 is formed so as to be porous to permit air and water to flow therethrough and to have a plenum 38 on its underside 23, to form an air pocket. An air valve 40 is provided on an air line 28. Air valve 40 is mounted on the edge 41 of the spa 10 to permit convenient adjustment.

Figure 3:
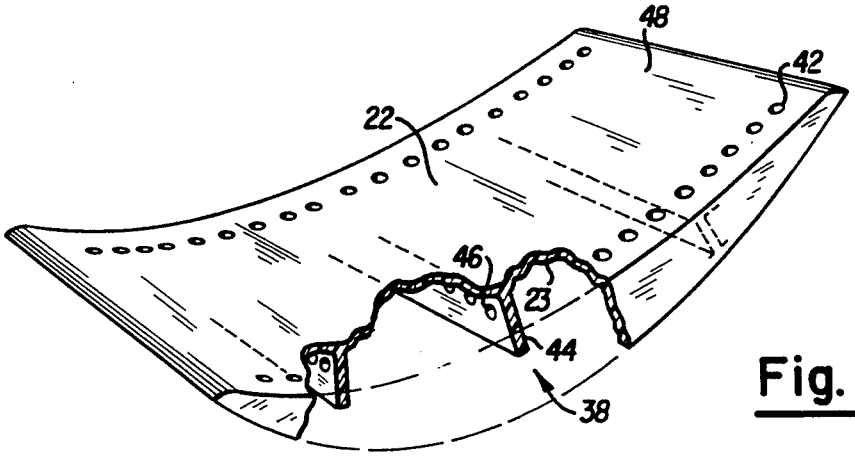
FIG. 3 is a perspective and partially fragmented view of the adjustable seat.

FIGS. 3–7 show details of the seat 22 and connection 31. FIG. 3 shows seat 22 formed as an arcuately-shaped element generally conforming to the shape of the human lower back and posterior. Holes 42 are provided, with baffles 44 having holes 46 therein provided on the underside to distribute air from nozzle 24 to form a plenum 38 to support an air pocket and to permit water and air to flow on the underside of the seat 22.

Figure 4:
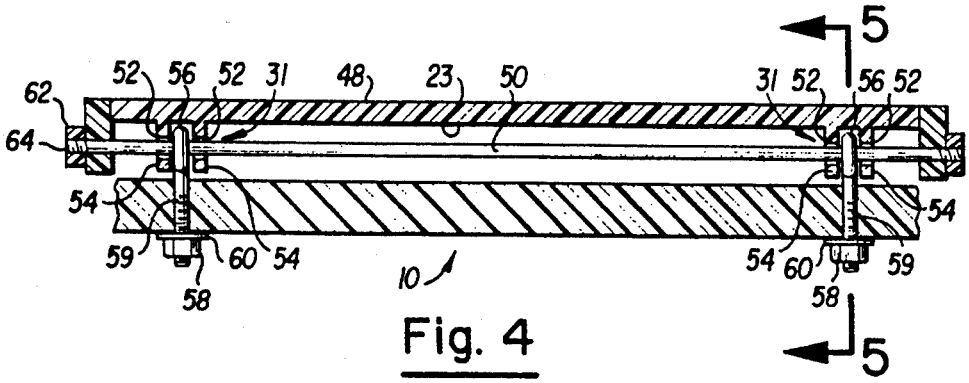
FIG. 4 is a sectional view taken along line 4—4 of FIG. 2 of a pivotable connection between the seat and spa.
Figure 5:
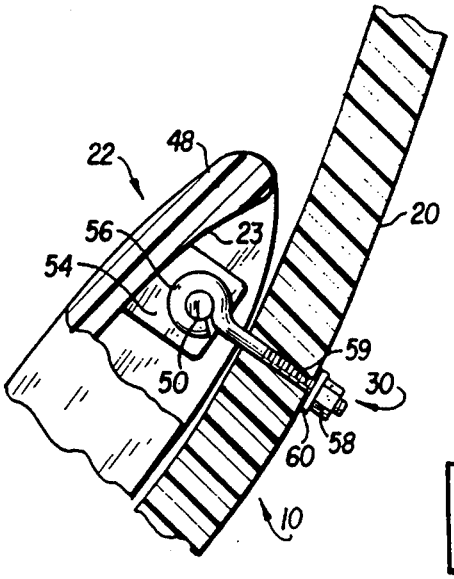
FIG. 5 is a sectional view taken along line 5—5 of FIG. 4 of the pivotable connection between the seat and spa.

FIGS. 4 and 5 show the connection 31 by which the seat upper end 48 is pivotably connected to the spa 10. Connection 31 includes a rod 50 passing through holes 52 in mounts 54 formed in seat 22. Mounts 54 capture the circular ends 56 of bolts 30 which are mounted by nuts 58 on threaded ends 59 in spa 10 through holes 60. Rod 50 is held in place in seat upper end 48 by nuts 62 over threaded ends 64 of rod 50.

The spa 10 and seat 22 are preferably constructed of ⅛ inch acrylic covering ¼ inch reinforced fiberglass The connection rod 50 and bolts 30 are preferably made of stainless steel. Other suitable materials known in the art may be used, however. Water line 26 and air line 28 are made of standard materials known in the art and are of sufficient inside diameter to provide flow rates sufficient to elevate seat 22.

The invention operates as follows:

The air valve 40 is opened to a desired setting. Water line 26 is connected to a recirculating pump as known in the art (not shown). The flow of water through water line 26 causes a pressure drop in air line 28 which results in air being drawn in through valve 40. The mixture of air and water flows through nozzle 24 into plenum 38 formed between seat 22 and base 20. Air is thus injected into plenum 38. This results in the formation of an air pocket which provides buoyancy to seat 22 and causes it to rise. In addition, depending upon the flow rates of air and water, pressure applied to the underside 23 of seat 22 also serves to elevate the seat. Because seat 22 is porous, the air and water flows through the seat, so the air pocket must be maintained by continuous flow of air into the seat plenum 38. The buoyancy and/or pressure causes the seat 22 to be lifted to the next height adjustment. Air escapes through the holes 42, 46 in the seat 22 into the water W in the spa. Typical water flow rates to effect sufficient pressure drop are approximately 20 gpm.

Figure 7:
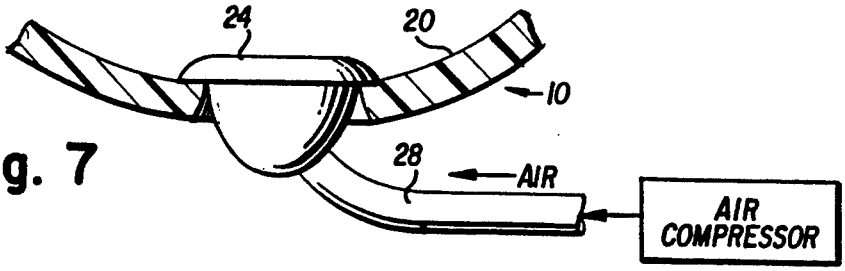
FIG. 7 is a detail showing an air line connected to a nozzle for use in a third embodiment of the invention.
Figure 6:
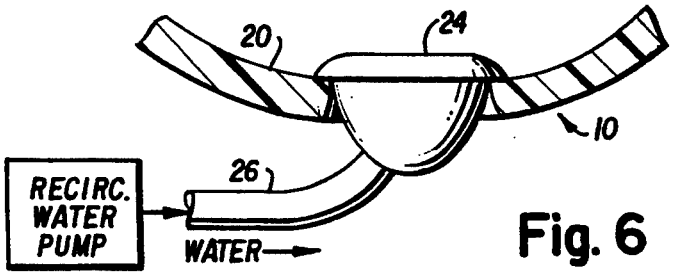
FIG. 6 is a detail showing a water line connected to a nozzle for use in a second embodiment of the invention.

FIGS. 6 and 7 illustrate alternate means of elevation of seat 22. FIG. 6 is directed to an alternate embodiment of the invention in which a nozzle 24 is connected only to a water line 26. Water pressure only, due to injection of a water jet from a high pressure water source such as a high pressure recirculation pump, is used to elevate the seat 22. The jet of high pressure water is directed at the underside 3 of seat 22. The operation of the seat 22 is otherwise the same as described above. Similarly, FIG. 8 is directed to an alternate embodiment of the invention in which a nozzle 24 is connected only to a high pressure air line 28. Air at a high pressure from an air compressor injects an air jet directed at seat underside 23 which elevates the seat 22 by a combination of pressure and buoyancy. Otherwise, the operation of the seat 22 is the same as described above.

While a spa 10 is shown having an integrally-formed lounge 12 provided with nozzle 24 and bolts 30 to which a seat 22 is to be mounted, it is contemplated that an existing spa can be retrofitted with a seating system to provide an adjustable seat according to the present invention. A height-adjustable seat is also contemplated for a non-lounge seating area.

FIG. 8 illustrates a spa 100 (shown in phantom) retrofitted with an alternative embodiment of a height-adjustable seat 122. Seat 122 is longer than the first seat embodiment 22. Seat 122 is arcuately shaped to conform to the lower back and posterior as well as to the upper legs of a user. As shown in FIGS. 8 and 9, seat 122 has a single hole 123 located near the lower end 147 thereof. No baffles are provided in the underside of seat 122. Rather a single plenum 138 is provided. As shown in FIGS. 8 and 10, seat 122 is pivotally connected at the upper end 148 thereof at connection 131. Nozzle 124 is located in the leg region, rather than the buttocks region. Seat 122 is positioned over nozzle 124, which is attached to water line 126 and air line 128, provided in base 120 of spa 100. Attachment bolts 130 are provided to hingedly support the seat 122 by connection 131. Air valve 140 is provided on air line 128 and mounted on edge 141 of spa 100 to permit convenient adjustment. Such a retrofit arrangement can be made by drilling appropriately placed holes in an existing spa for nozzle 124 and air valve 140. Alternatively, a spa can be made which incorporates seat 122, nozzle 124, air valve 140, water line 126 and air line 128 as original equipment items.

The operation of spa 100 with seat 122 is the same as that described for spa 10 and seat 22 Raising and lowering of the seat 122 is accomplished strictly by the combination of air and water pressure from nozzle 124. In addition, only hole 123 is used to permit air and water to flow through seat 122 from plenum 138. The seat occupant's entire weight is not placed on the seat 122 due to buoyancy of the occupant in the water-filled spa. Hence, by balancing between the amount of applied occupant weight and the buoyancy due to air flow to plenum 138, the occupant can adjust the seat 122 height while seated thereon.

Although preferred embodiments of the invention have been described herein, it will be apparent to those skilled in the art to which the invention pertains that variations and modifications of the described embodiments may be made without departing from the spirit and scope of the invention. Accordingly, it is intended that the invention be limited only to the extent required by the appended claims and the applicable rules of law.

What is claimed is:

1. A space comprising:

a vessel for holding a volume of water, an area for seating formed in said water holding vessel, a nozzle for injecting air into the volume of water, and a seat mounted in said seating area and movably connected to said vessel and located over said air injecting nozzle, said seat movable vertically in response to air buoyancy, whereby said seat is vertically movable while a user is seated thereon by injection of air through said air injecting nozzle into the volume of water.

2. A spa as in claim 1, wherein said seat is pivotally connected at a top portion to said spa.

3. A spa as in claim 1, wherein said seat is arcuately shaped and having an underside and provided with a plenum on the underside thereof.

4. A spa as in claim 1, wherein said seat includes an underside which is formed having a single plenum.

5. A spa as in claim 1, wherein said seat includes a single hole formed therein to permit air to escape from said seat plenum.

6. A height adjustable seating system adapted for mounting in a spa, comprising:

a seat having a plenum formed therein to support an air pocket, said air pocket capable of elevating said seat by buoyancy, said seat movable vertically in response to said buoyancy;

means for movably connecting said seat to said spa;

a nozzle located so as to communicate with said seat plenum; and an air supply line communicating with said nozzle to provide air to said seat plenum as a source of buoyancy for elevating said seat, whereby said seat is adjustable in height while a user is seated thereon by action of air buoyancy in said seat plenum.

7. A seating system as in claim 6, wherein said connecting means comprises a pivotal connection to said spa, located at a top portion of said seat.

8. A seating system as in claim 6, wherein said seat is arcuately shaped and having an underside and provided with a plenum on the underside thereof.

9. A seating system as in claim 6, wherein said system is adapted to be retrofitted to an existing spa.

10. A seating system as in claim 6, wherein said seat includes an underside which is formed having a single plenum.

11. A seating system as in claim 6, wherein said seat includes a single hole formed therein to permit air to escape from said seat plenum.

12. A spa comprising:

a vessel for holding a volume of water, an area for seating provided in said water holding vessel, said seating area being contoured to receive a user in a reclining position, a source of fluid pressure comprising a nozzle for injecting a jet of air at a high pressure into the volume of water, a seat movably connected to said vessel, said seat having an underside surface and mounted in said seating area over said air injecting nozzle, whereby said seat is adjustable in height by elevation due to air pressure of said jet of high pressure air against said underside surface of said seat.

* * * * *

UNITED STATES PATENT AND TRADEMARK OFFICE

CERTIFICATE OF CORRECTION

PATENT NO. : 5,448,787

DATED : September 12, 1995

INVENTOR(S) : Don T. Allen

It is certified that error appears in the above-indentified patent and that said Letters Patent is hereby corrected as shown below:

Column 3, line 16, after "fiberglass" insert a period --.--

Column 4 (claim 1), line 44, change "space" to --spa--.

Signed and Sealed this

Twenty-seventh Day of January, 1998

*Attest:*

*Attesting Officer*

BRUCE LEHMAN

*Commissioner of Patents and Trademarks*